US006226940B1

(12) United States Patent
Biebuyck et al.

(10) Patent No.: US 6,226,940 B1
(45) Date of Patent: May 8, 2001

(54) MULLION CONNECTION SYSTEM

(76) Inventors: Lawrence F. Biebuyck, 2322 Club Creek Blvd., Garland, TX (US) 75043; James P. Clark, 1015 Meredith, Terrell, TX (US) 75160; Jarett B. Gibson, Rte. 6, Box 80, Kemp, TX (US) 75143

( * ) Notice: Subject to any disclaimer, the term of this patent is extended or adjusted under 35 U.S.C. 154(b) by 0 days.

(21) Appl. No.: 09/376,636

(22) Filed: Aug. 18, 1999

Related U.S. Application Data

(60) Provisional application No. 60/116,887, filed on Jan. 22, 1999.

(51) Int. Cl.[7] ..... E04B 2/88

(52) U.S. Cl. ..... 52/235

(58) Field of Search ..... 52/204.6, 204.61, 52/656.5, 456, 656.6, 656.9, 204.58, 235, 143; 312/101, 140

(56) References Cited

U.S. PATENT DOCUMENTS

| | | | | |
|---|---|---|---|---|
| 3,293,813 | * | 12/1966 | Emmons et al. | 52/456 X |
| 3,526,071 | | 9/1970 | Watanabe | 52/403.1 |
| 3,842,554 | | 10/1974 | Swick | 52/235 |
| 3,940,897 | * | 3/1976 | Stoakes | 52/235 X |
| 4,008,552 | | 2/1977 | Biebuyck . | |
| 4,141,188 | | 2/1979 | Sukolics | 52/395 |
| 4,275,533 | * | 6/1981 | Wright | 52/143 X |
| 4,453,355 | | 6/1984 | Stoakes | 52/235 |
| 4,707,959 | | 11/1987 | Stoakes | 52/235 |
| 4,738,065 | | 4/1988 | Crandell | 52/235 |
| 5,253,459 | | 10/1993 | Parinas et al. | 52/235 |
| 5,323,577 | | 6/1994 | Whitmyer | 52/235 |
| 5,381,637 | | 1/1995 | Farag | 52/204.595 |
| 5,467,566 | | 11/1995 | Swartz et al. | 52/235 |
| 5,598,672 | | 2/1997 | Nawa | 52/235 |
| 5,934,038 | * | 8/1999 | Clausen | 52/143 X |
| 6,006,489 | * | 12/1999 | Zadok | 52/235 X |

FOREIGN PATENT DOCUMENTS

| | | | | |
|---|---|---|---|---|
| 2234992 | * | 2/1991 | (GB) | 52/235 |

* cited by examiner

*Primary Examiner*—James O. Hansen
(74) *Attorney, Agent, or Firm*—Jenkens & Gilchrist, P.C.

(57) ABSTRACT

A mullion connection system includes a non-rectangular shear block which is formed by making angled, parallel cuts in a section of extruded material.

4 Claims, 7 Drawing Sheets

MULLION CONNECTION SYSTEM

This patent application claims the benefit of U.S. Provisional Application No. 60/116,887 filed Jan. 22, 1999.

FIELD OF THE INVENTION

The present invention pertains to a mullion connection system for use in a window wall or curtain wall system. Specifically disclosed is a system for connecting those mullions having a unique shape or configuration, one to another.

BACKGROUND

A conventional window wall or curtain wall system 100 is shown in FIG. 1. Typically such conventional window wall or curtain wall systems include a plurality of support mullions 102 oriented generally along horizontal and vertical lines. The mullions, when connected one to another provide a structure for supporting substantially rigid wall or window panels 104. Each supported, substantially rigid wall or window panel typically has a rectangular shape characterized by two sets of parallel edges. Such window wall or curtain wall systems may include just a single wall or window panel or multiple wall or window panels as shown in FIG. 1. Window wall or curtain wall systems have been used both in interior spaces and as external walls in buildings. Additionally, window wall or curtain wall systems 100 have been used in vehicles such as buses, airplanes, trains, or boats.

Shown in FIG. 2 is a simplified example of a system 200 for connecting a horizontal mullion 202 to a vertical mullion 204. While the mullions shown in FIG. 2 are simple box beams, most present day mullions used in window wall or curtain wall systems are usually complex extruded forms. In the exemplary diagram shown in FIG. 2, the shear block 206 is attached to the vertical mullion 204 using fasteners 208. The fasteners 208 typically enter the mullion at an angle which is substantially perpendicular to an exterior surface of the mullion. Once the shear block 206 is attached to the mullion 204, the substantially hollow horizontal mullion 202 is then slid over the shear block 206.

FIG. 3 illustrates two types of shear blocks 302, 304 used in actual practice. As shown in FIG. 2, fasteners 306, which typically pass through the shear blocks at an angle which is substantially perpendicular to the exterior surface of the mullion block, are used to attach the shear blocks shown in FIG. 3 to the vertical mullion 308.

In window wall or curtain wall installations employing mullions with more complex non-orthogonal shapes, because of either construction or aesthetic considerations, it is necessary to use a shear block having a more complex shape to both fit within the mullion and to assure that the fasteners pass into the mullion at an angle which is substantially perpendicular to an exterior surface. For example, in the system 400 illustrated in FIG. 4, a specially manufactured diamond-shaped vertical mullion 402 is used instead of the box beam 204 shown in FIG. 2. Because of the use of a diamond-shaped mullion 402, the shear block 404 must be formed such that a top and bottom plan view of the shear block 404 would have the shape of a non-rectangular parallelogram having two short minor edges 406 and two longer major edges 408. The use of a non-rectangular parallelogram enables the compound fastening of non-orthogonal surfaces. Additionally, the fastener holes 410 must be re-oriented in the shear block 404 so that their long axis is substantially perpendicular to the external surface of the mullion. This assures proper attachment of the shear block 410 to the mullion 402. Typically, prior art specially created shear blocks 404 enable the use of non-orthogonal mullions in custom window wall or curtain wall installations and are specially produced in small volumes by making special molds or castings. If the specially designed and specially manufactured shear block further requires the inclusion of channels, ears, fingers, legs, spines, etc., as shown in shear blocks 302 and 304 in FIG. 3, to accommodate and properly orient fasteners with respect to the outer surface of the mullion, the design and manufacture of such specially made shear blocks is expensive. And, because such specially designed and specially made shear blocks are produced in relatively small quantities, their unit cost is high. As the design of specially made shear blocks depends on the shape of the mullions and the design of the particular window wall or curtain wall system, unused specially designed shear blocks have little use on other installations and are usually discarded as scrap.

As the complexity of shear block design increases with the complexity of the design of window wall or curtain wall systems, so too does the chance for error when designing and manufacturing the required specially made shear blocks. There is therefore a need in the art to create a shear block system for use in connecting mullions, one to another, that is inexpensive, easy to manufacture and reduces the possibility for errors or rework.

SUMMARY OF THE INVENTION

The mullion connection system of the present invention includes an improved shear block that is inexpensive, easy to manufacture, and reduces the possibility for errors or rework.

The mullion connection system described herein provides for the joinder of two mullions together in a window wall or curtain wall system by using an angulated shear block which is cut from a section of extruded material (metallic or non-metallic). By cutting the shear block from a section of extruded material rather than using a special mold or casting to manufacture an individual shear block, the opportunity is created for a variety of different mounting hole orientations and positions in the central portion of the shear block. By cutting an extruded shear block which already includes a substantially solid central portion, the needed channels, ears, fingers, legs, and splines that enable the receipt and orientation of fasteners, the prior art requirement to specially form channels, ears, fingers, legs and spines in shear blocks has been eliminated.

The present invention eliminates the need for special molds or multiple castings or dies to manufacture a shear block that has angled side walls, a unique shape which is specially formed to fit in the intersection of interengaging structural support mullions and precisely oriented channels, ears, fingers, legs and splines. The shear block of the present invention is particularly useful when connecting unusual angular configurations of support mullions or with specially shaped decorative mullions.

The inventors herein have recognized that the cost of a single block of extruded material, from which the shear blocks of the present invention may be cut, is much cheaper and faster than the prior art practice of casting or specially machining multiple extruded parts or a limited number of specially designed and manufactured shear blocks.

The inventors herein have also realized that the section of extruded material, from which the shear blocks used in the mullion connection system of the present invention are cut, can also be used to manufacture a wide array of other shear blocks which are usable with multiple curtain wall or window wall installations. Since the shape of the mullions in a particular window wall or curtain wall system will generally be fixed throughout a portion thereof, the same extrusion can be used for different applications within the same window wall or curtain wall system by simply cutting the shear block out of extruded bar stock at different angles to create the needed variations in the angle necessary to attach one mullion to another.

The essence of the instant invention is the utilization of a single extruded bar of material which may or may not be solid to form different angulated shear blocks, each having a unique configuration which describes the appropriate angles for interconnecting support mullions, one to another.

BRIEF DESCRIPTION OF THE DRAWINGS

A better understanding of the mullion connection system of the present invention may be had by reference to the drawing figures wherein.

DESCRIPTION OF THE EMBODIMENTS

The present invention is best understood by reference to FIGS. 5, 6, 6A, and 7.

Figure 5:
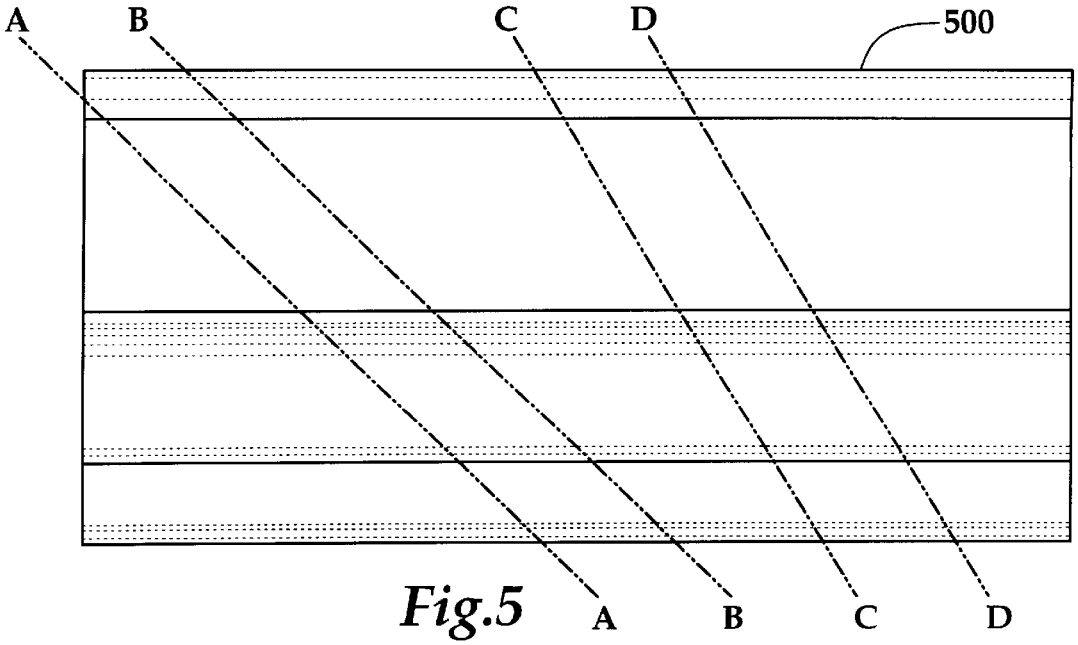
FIG. 5 is a top plan view of an extruded piece of material.
Figure 6:
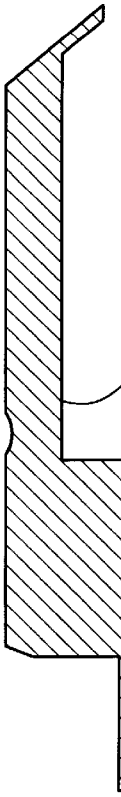
FIG. 6 is an end view of the extruded material shown in FIG. 5.
Figure 6A:
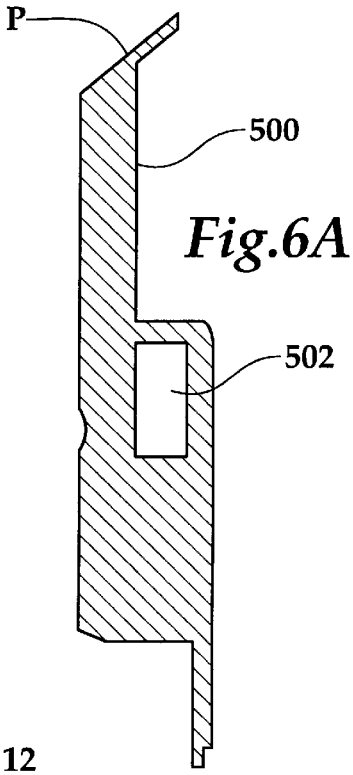
FIG. 6A is an end view of a bar of extruded material having substantially the same perimeter as shown in FIG. 6 but further including a hollow section.

Shown in FIGS. 5, 6 and 6A is a block of extruded material 500, which may or may not be solid in construction. The complex perimeter P of the solid section of extruded material 500 may be best seen by reference to FIGS. 6 and 6A. Note that in FIG. 6A, the section of extruded material may include a hollow section 502. The section of extruded material 500 has a particularly unique shape. The reason for this particularly unique shape is the necessity of inserting this block of extruded material into the interior portion of a substantially hollow support mullion of similar shape. It is through the insertion of the shear block into the hollow portion of the substantially hollow mullion that two mullions are connected together to provide a supporting framework for a panel used in a window wall or curtain wall system 100 as shown in FIG. 11.

Figure 11:
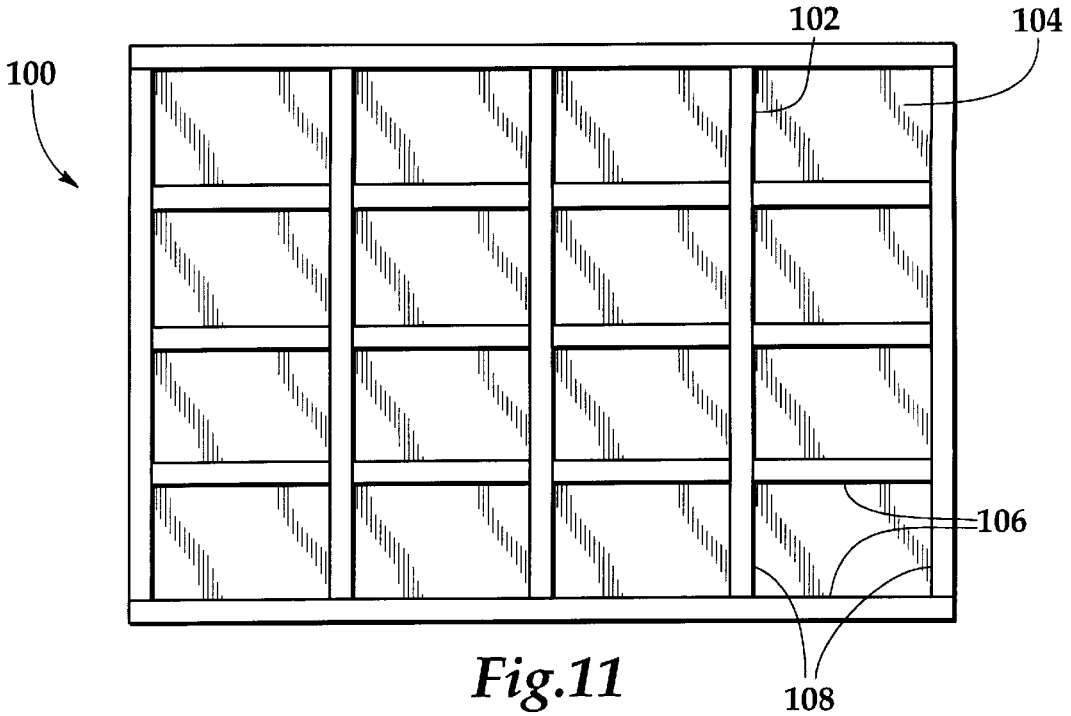
FIG. 11 is a front elevational view of a window wall or curtain wall system featuring the mullion connection system according to the present invention.

Typically panels 104 used in window wall or curtain wall systems (as shown in FIG. 11) have a pair of substantially parallel first edges 106 and a pair of substantially parallel second edges 108. In most applications the pair of substantially parallel first edges 106 and the pair of substantially second edges 108 are perpendicular one to another. It is the framework or network of mullions 102 that supports the panels 104 of substantially rigid material to form what has become known as a window wall or curtain wall system 100.

Figure 1:
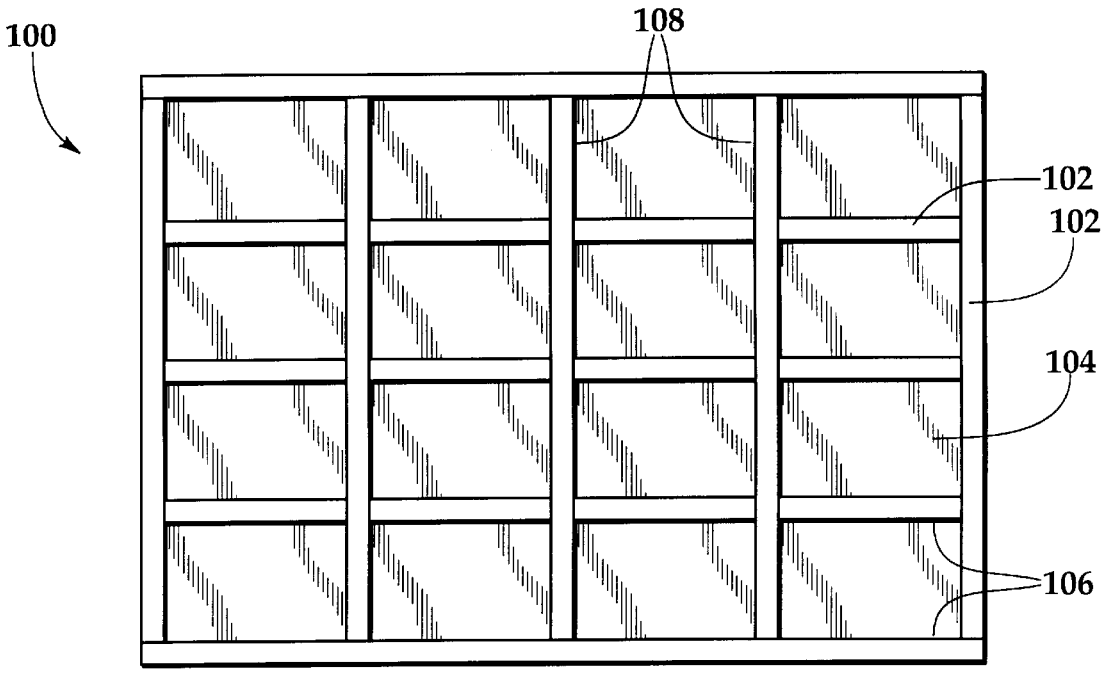
Fig.1 (PRIOR ART)
FIG. 1 is a front elevational view of a typical prior art window wall or curtain wall system.
Figure 2:
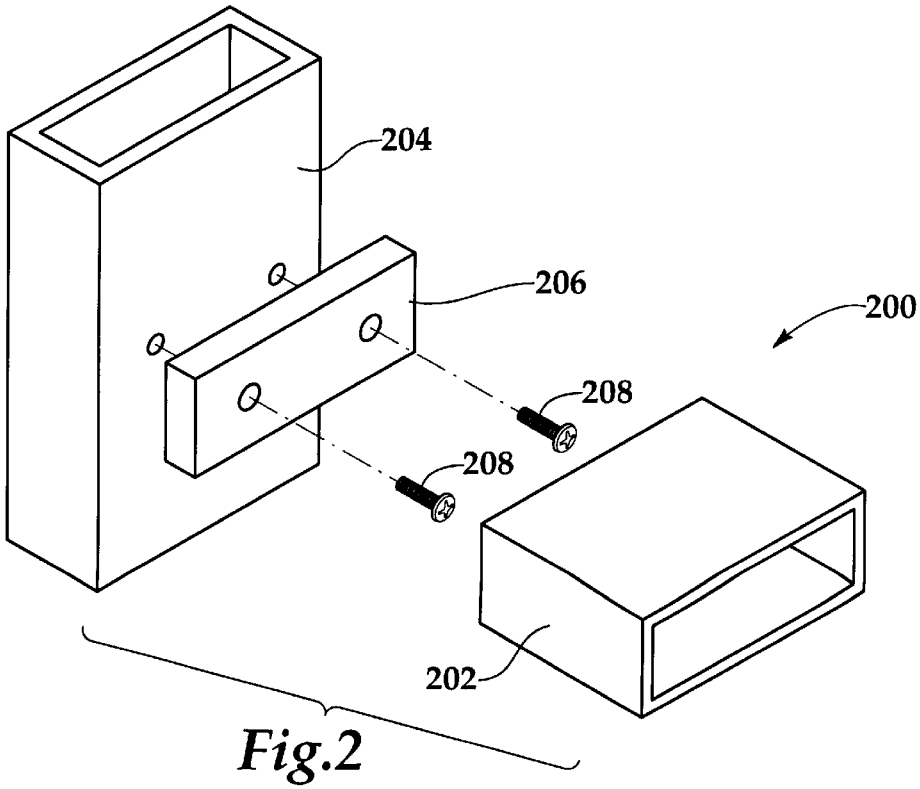
Fig.2 (PRIOR ART)
FIG. 2 is an exploded perspective view of a simplified typical prior art mullion connection system.
Figure 3:
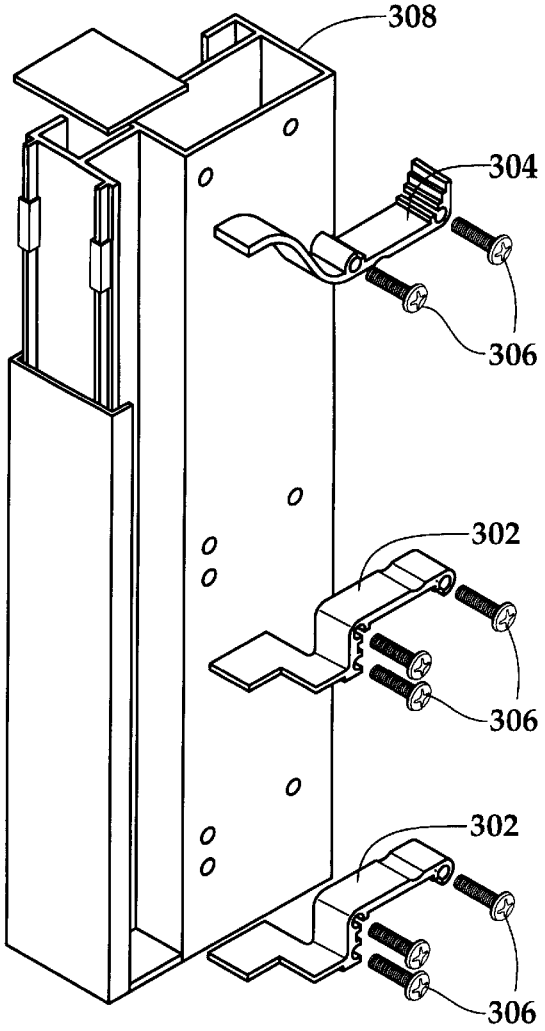
Fig.3 (PRIOR ART)
FIG. 3 is a perspective view of a typical prior art mullion connection system utilizing a plurality of shear blocks.
Figure 4:
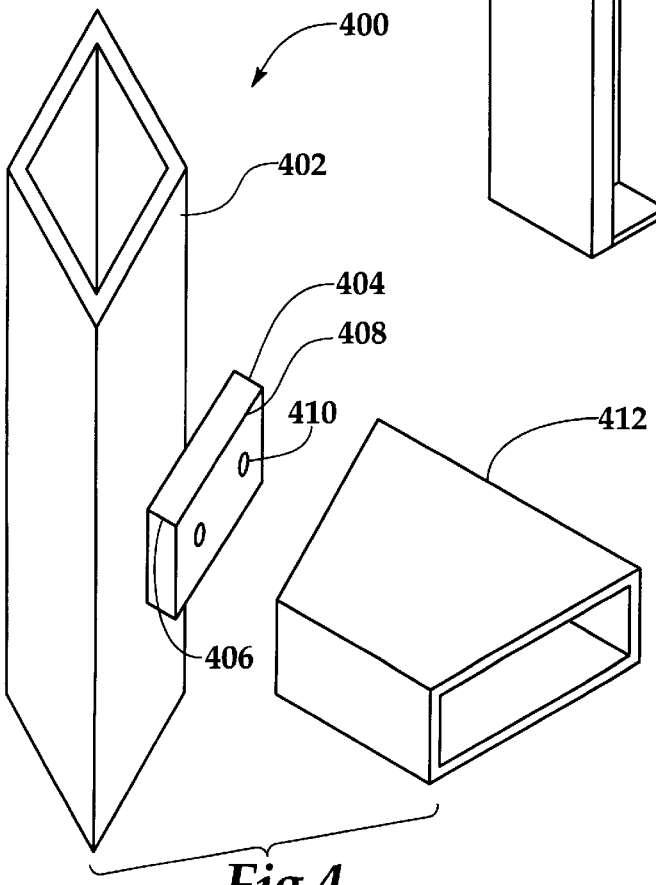
Fig.4 (PRIOR ART)
FIG. 4 is a perspective view of a more complex prior art mullion support system for connecting box-shaped mullion to a non-orthogonal diamond-shaped mullion.

If the support mullions 402, 412 have a unique shape or are connected to each other at non-standard angles as shown in FIG. 4, then there is a need for a uniquely formed shear block.

Figure 7:
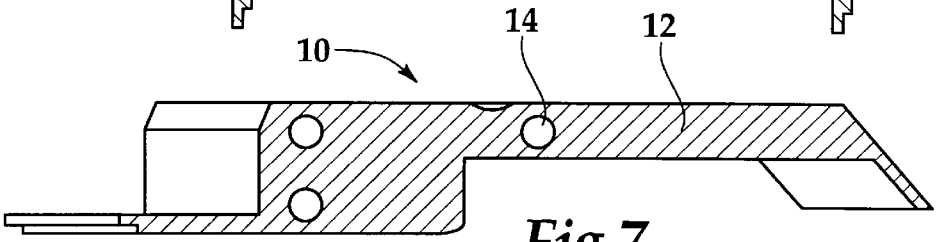
FIG. 7 is a end view of a shear block manufactured according to the present invention.
Figure 8:
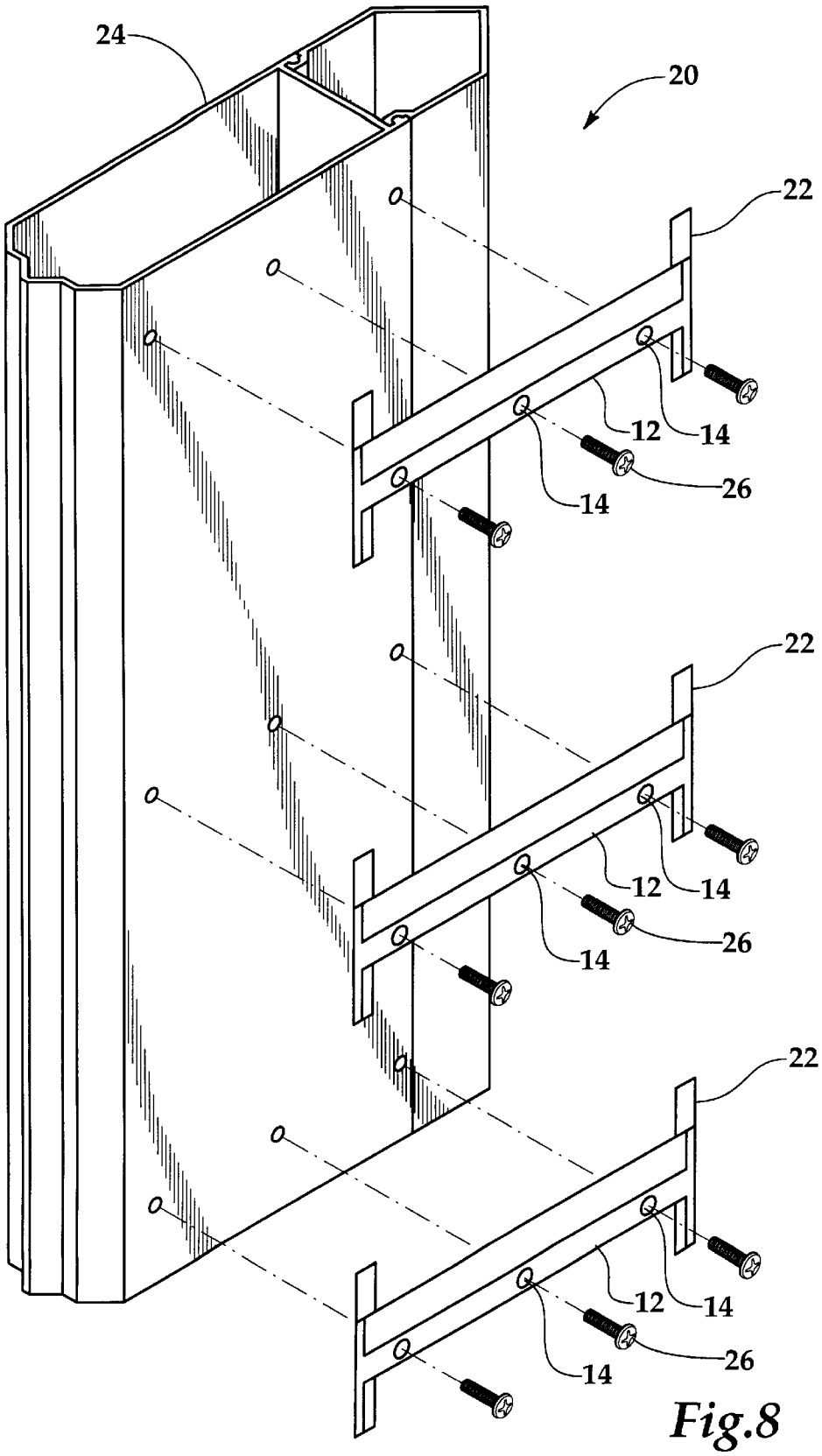
FIG. 8 is an exploded perspective view of a mullion connection system according to the present invention.

According to the present invention this uniquely formed shear block may be formed by cutting a solid block of extruded material 500 such as shown in FIG. 5, along parallel lines corresponding to the angle at which the support mullions are joined one to another. When the block of extruded material 500 is cut along these parallel lines a shear block 22 having an overall outline, in a top or bottom plan view, in the shape of a parallelogram, is formed. An end view of this unique shear block 22 is shown in FIG. 7. Referring now to FIG. 8, it is to be noted that a portion 12 of the shear block 22 is sufficiently solid so that fastener holes 14 may be drilled therethrough. These fastener holes 14 may be located at the proper position and at the proper angular orientation to allow fasteners to pass therethrough and into a support mullion at an angle which is substantially perpendicular to the exterior surface of the mullion.

As shown in FIG. 5 the block of material 500 may be used for both mullions requiring a shear block angle of 45° wherein the parallel, angled cuts would be made along lines A—A and B—B or a shear block requiring an angle of approximately 60° requiring cuts along lines C—C and D—D or at any other angles dictated by the unique shape or configuration of the mullions to be connected one to another. In prior art systems, a change in the angle of a shear block would require the design and manufacture of a new shear block. Because of the present invention, all that is required to change the angle of a shear block is to change the angle of the cut through the section of extruded material 500.

Figure 9:
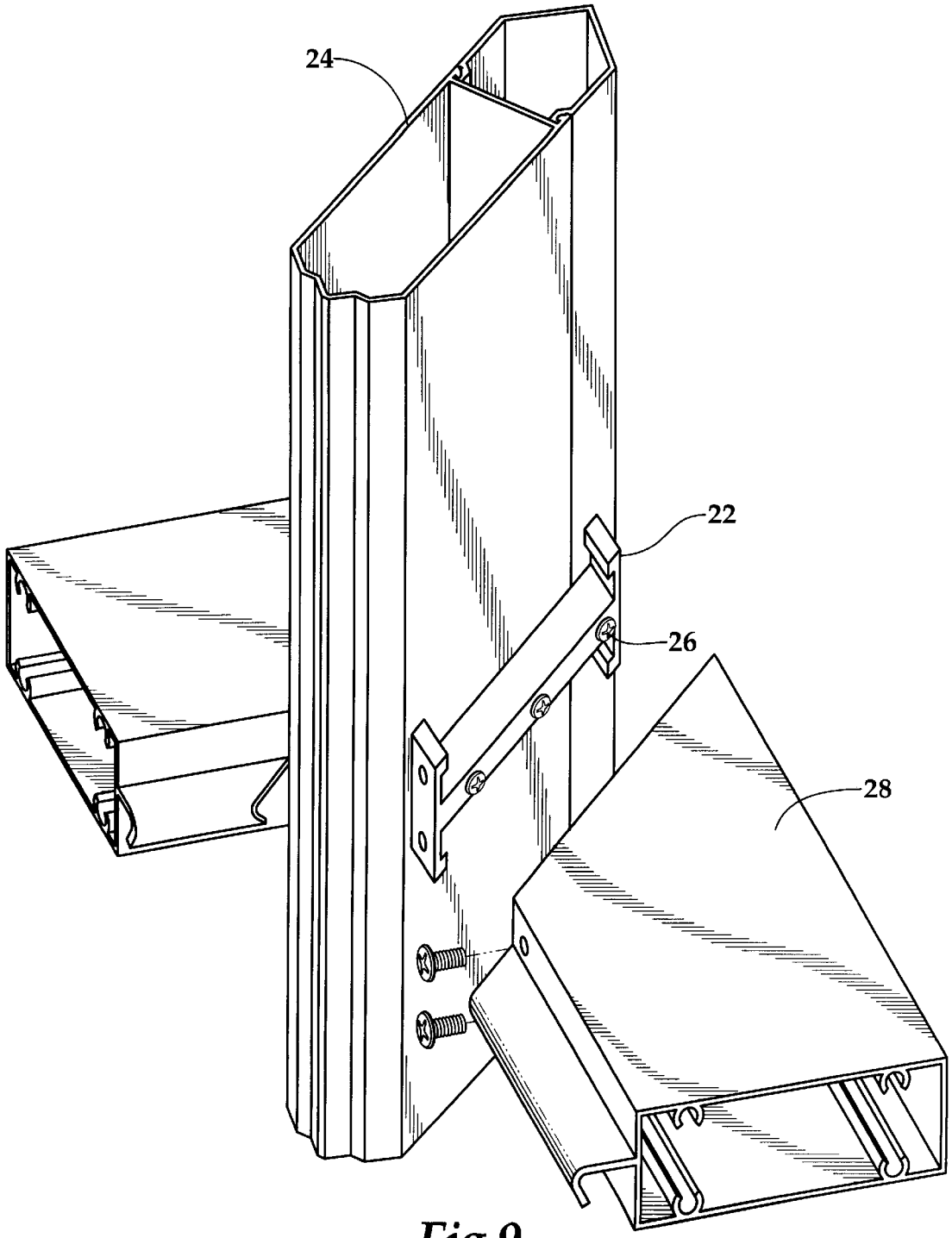
FIG. 9 is a perspective view of a mullion assembly including the shear block assembly of the present invention.

FIG. 8 shows an exploded support mullion-shear block system 20 wherein a shear block 22 manufactured according to the present invention is connected to a vertical support mullion 24 using fasteners 26. A better understanding of how the mullion connection system of the present invention comes together is shown in FIG. 9 where one of the angulated shear blocks 22 is mounted by fasteners 26 to a vertical mullion 24 before the substantially horizontal mullion 28 is placed over the shear block 22 and connected to the substantially vertical mullion 24. The fasteners 26 pass through the shear blocks 22 to enter the vertical mullion 24 at an angle which is substantially perpendicular to the outer surface of the mullion.

Figure 10:
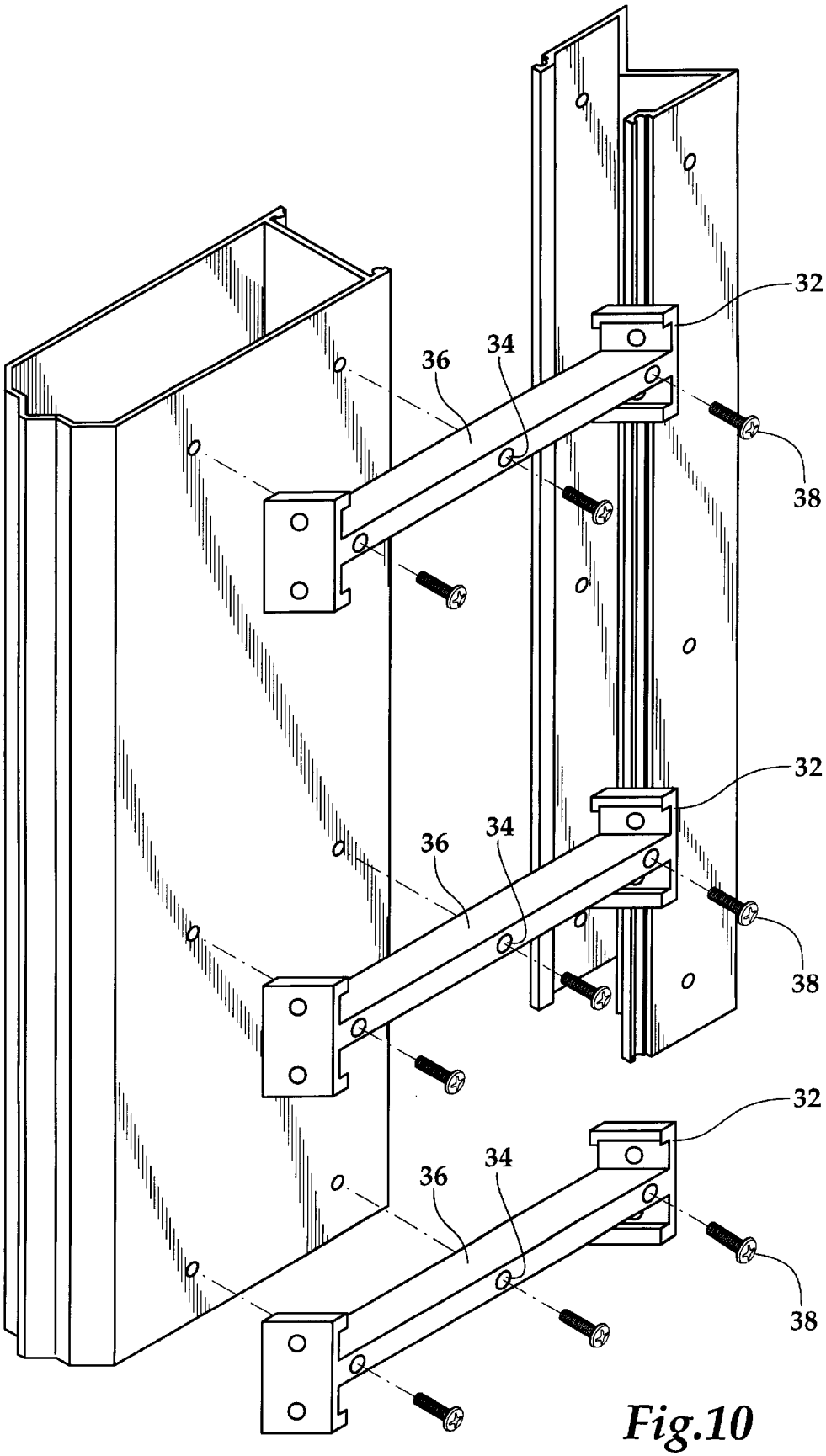
FIG. 10 is a perspective view of an alternate embodiment of the mullion connection system of the present invention.

By reference to FIG. 10 the unique advantage of the present invention is shown. Note that the shear blocks 32 shown in FIG. 10 have substantially the same configuration as the shear blocks 22 shown in FIG. 8 and 9 but for the fact that they are angulated in an opposite direction. In prior art installations it would have been necessary to make a special extrusion or a unique casting to manufacture the different shear blocks 22, 32 shown in FIG. 8 and in FIG. 10. While symmetrical shear blocks are shown, those of ordinary skill in the art will understand that the blocks need not be symmetrical. Because of the present invention, the need to specially design and manufacture the shear block 32 shown in FIG. 10 is eliminated. All that would be necessary to produce the shear block 32 shown in FIG. 10 would be to cut an extruded section of material having the desired cross-section along parallel lines in an opposite direction from those used in FIG. 8 to form the shear blocks 32 shown in FIG. 10. As previously indicated, fastener holes 34 may be drilled at substantially a ninety degree angle through the solid central portion 36 of the shear block 32 for the passage of fasteners 38. Drilling holes at a substantially ninety degree angle through the shear clip enables drilling holes into the mullion at substantially ninety degrees. The term "substantially ninety degrees" as used herein, includes angles which are not exactly 90°, but sufficiently close to facilitate the above described drilling step. By way of example only, an angle of around 86° could be accceptable in certain configurations.

Figure 12A:
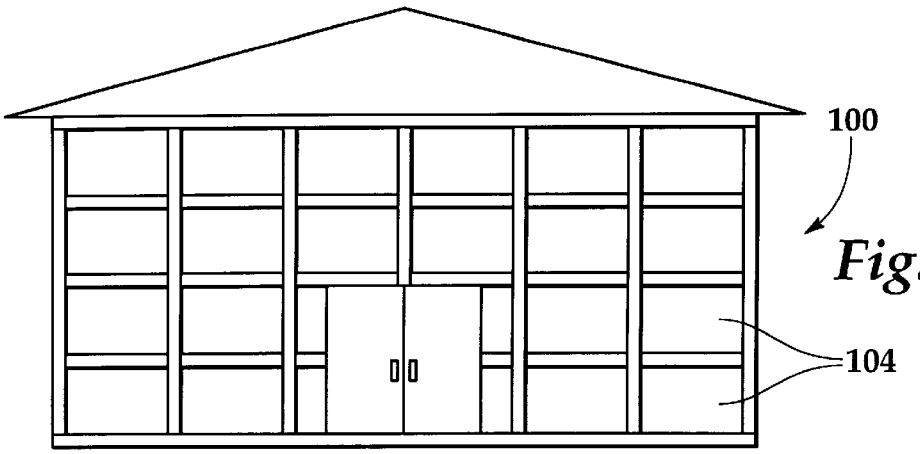
FIG. 12A is a front elevational view of a building having a curtain wall featuring the mullion connection system according to the present invention.
Figure 12B:
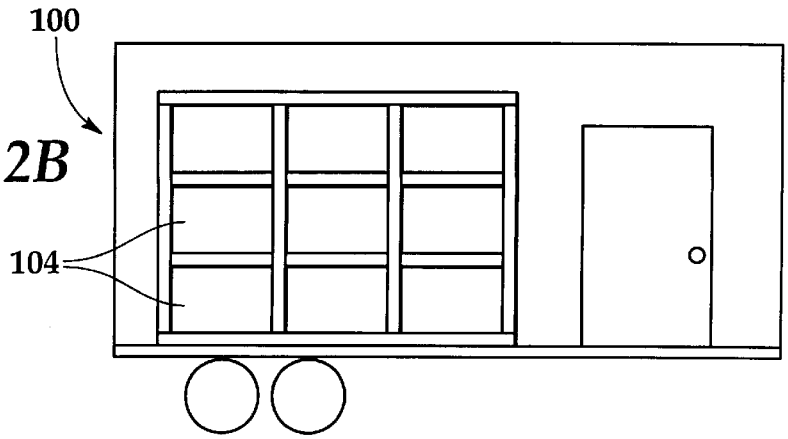
FIG. 12B is a front elevational view of a vehicle having a curtain wall featuring the mullion connection system according to the present invention.

Referring now to FIG. 12A, it has been found that the mullion connection system of the present invention has utility in curtain wall or window wall systems found in the interior or on the exterior of buildings; wherein the buildings include a foundation, at least one floor, outer walls and inner walls. Alternatively, as shown in FIG. 12B, the mullion connection system of the present invention may be used in vehicles having a frame, an outer body and a floor. As the present invention has been explained by reference to its preferred and alternate embodiments, those of ordinary skill in the art will understand that numerous other embodiments of the present invention have been enabled. Such other embodiments shall fall within the scope and meaning of the appended claims.

What its claimed is:

1. A window wall or curtain wall system comprising:

a panel of substantially rigid material having a pair of substantially parallel first edges and a pair of substantially parallel second edges, said pairs of substantially parallel first and second edges being substantially perpendicular one to another;

a non-orthogonal first mullion constructed and arranged for supporting said panel of substantially rigid material along at least one of said first edges;

a substantially hollow second mullion constructed and arranged for supporting said panel of substantially rigid material along at least one of said second edges;

a non-rectangular shear block for connecting said non-orthogonal first mullion to said substantially hollow second mullion;

said non-rectangular shear block being cut from a section of extruded material along angled, substantially parallel lines;

said section of extruded material having a perimeter constructed and arranged to fit within a hollow portion of said substantially hollow second mullion;

said non-rectangular shear block further including a solid central portion through which a plurality of fastener holes may be formed wherein said plurality of fastener holes are oriented along an axis substantially perpendicular to an exterior surface of said non-orthogonal first mullion; and whereby said non-rectangular shear block may be used to connect said substantially hollow second mullion to said first non-orthogonal mullion by attaching said shear block to said non-orthogonal first mullion by passing fasteners through said plurality of fastener holes in the solid central portion of said shear block and into said first non-orthogonal mullion and passing the hollow portion of said second mullion over said non-rectangular shear block.

2. A method for connecting a non-orthogonal first mullion to a second substantially hollow mullion to mount a panel in a window wall or curtain wall system for a structure, said method comprising the steps of:

positioning the non-orthogonal first mullion in a predetermined position with respect to the structure;

attaching a non-rectangular shear block to the non-orthogonal first mullion with fasteners so that said fasteners enter said non-orthogonal first mullion at a substantially ninety degree angle;

said non-rectangular shear block being cut from a section of extruded material along substantially parallel lines and further including a solid central portion including at least one fastener hole, said fastener hole being oriented at an angle which is substantially ninety degrees to the surface of the non-orthogonal first mullion;

said non-rectangular shear block being further constructed and arranged to fit within a substantially hollow portion of the second substantially hollow mullion; and attaching said second substantially hollow mullion to said non-orthogonal first mullion by passing the hollow portion of the second mullion over said non-rectangular shear block.

3. A building, said building comprising:

a foundation;

at least one floor;

at least one inner wall;

at least one outer wall;

a plurality of window wall or curtain wall systems included within said at least one inner wall or said at least one outer wall, said plurality of window wall or curtain wall systems including;

a panel of substantially rigid material having a pair of substantially rigid material having a pair of substantially parallel first edges and a pair of substantially parallel second edges, said pairs of substantially parallel first and second edges being substantially perpendicular one to another;

a non-orthogonal first mullion constructed and arranged for supporting said panel of substantially rigid material along at least one of said first edges;

a substantially hollow second mullion constructed and arranged for supporting said panel of substantially rigid material along at least one of said second edges;

a non-rectangular shear block for connecting said first non-orthogonal mullion to said substantially hollow second mullion;

said non-rectangular shear block being cut from a section of extruded material along angled, substantially parallel lines;

said section of extruded material having a perimeter constructed and arranged to fit within a hollow portion of said substantially hollow second mullion;

said non-rectangular shear block further including a solid central portion through which a plurality of fastener holes may be formed wherein said plurality of fastener holes are oriented along an axis substantially perpendicular to an exterior surface of said non-orthogonal first mullion; and whereby said non-rectangular shear block may be used to connect said substantially hollow second mullion to said first non-orthogonal mullion by attaching said non-rectangular shear block to said non-orthogonal first mullion by passing fasteners at substantially ninety degree angle to said cut through said plurality of fastener holes in the solid central portion of said shear block and into said first non-orthogonal mullion and passing the hollow portion of said second mullion over said non-rectangular shear block.

4. A vehicle, said vehicle comprising:

a frame;

an outer body;

at least one floor;

at least one curtain wall or window wall system, said window wall or curtain wall system including;

a plurality of window wall or curtain wall systems included in said outer body or inside said outer body, said plurality of window wall or curtain wall systems including;

a panel of substantially rigid material having a pair of substantially parallel first edges and a pair of substantially parallel second edges, said pairs of substantially parallel first and second edges being substantially perpendicular one to another;

a non-orthogonal first mullion constructed and arranged for supporting said panel of substantially rigid material along at least one of said first edges;

a substantially hollow second mullion constructed and arranged for supporting said panel of substantially rigid material along at least one of said second edges;

a non-rectangular shear block for connecting said non-orthogonal first mullion to said substantially hollow second mullion;

said non-rectangular shear block being cut from a section of extruded material along angled, substantially parallel lines;

said section of extruded material having a perimeter constructed and arranged to fit within a hollow portion of said substantially hollow second mullion;

said non-rectangular shear block further including a solid central portion through which a plurality of fastener holes may be formed wherein said plurality of fastener holes are oriented along an axis substantially perpendicular to an exterior surface of said non-orthogonal first mullion; and whereby said non-rectangular shear block may be used to connect said substantially hollow second mullion to said non-orthogonal first mullion by attaching said non-rectangular shear block to said non-orthogonal first mullion by passing fasteners through said plurality of fastener holes in the solid central portion of said non-rectangular shear block and into said first mullion and passing the hollow portion of said second mullion over said non-rectangular shear block.

* * * * *

UNITED STATES PATENT AND TRADEMARK OFFICE

CERTIFICATE OF CORRECTION

PATENT NO. : 6,226,940 B1
DATED : May 8, 2002
INVENTOR(S) : Biebuyck et al.

It is certified that error appears in the above-identified patent and that said Letters Patent is hereby corrected as shown below:

Title page,
Item [73], insert Assignee: -- Vistawall Architectural Products, Terrell Texas --

Signed and Sealed this

Eighteenth Day of June, 2002

*Attest:*

*Attesting Officer*

JAMES E. ROGAN
*Director of the United States Patent and Trademark Office*